US005078211A

United States Patent [19]

Swineford

[11] Patent Number: 5,078,211

[45] Date of Patent: Jan. 7, 1992

[54] PLASTIC PACKER

[76] Inventor: Richard A. Swineford, 202 Rt. 511, Nova, Ohio 44859

[21] Appl. No.: 452,778

[22] Filed: Dec. 19, 1989

[51] Int. Cl.[5] ..... E21B 33/12

[52] U.S. Cl. ..... 166/202; 166/203; 277/208; 277/212 R

[58] Field of Search ..... 166/153, 170, 179, 180, 166/195, 196, 202, 203; 277/208, 212 R, 212 C, 212 F, 207 R, 207 A, DIG. 6; 285/417–419, 422

[56] References Cited

U.S. PATENT DOCUMENTS

| | | | |
|---|---|---|---|
| 750,205 | 1/1904 | Layne | 166/196 |
| 1,262,107 | 4/1918 | Sheasley | 166/202 X |
| 1,771,556 | 7/1930 | Cox | 166/195 X |
| 2,452,466 | 10/1948 | Jaswell | 166/179 X |
| 2,719,768 | 10/1955 | Webber | 166/202 |
| 3,057,408 | 10/1962 | Griffitts | 277/212 X |
| 3,249,685 | 5/1966 | Heflin | 277/207 A |
| 3,385,367 | 5/1968 | Kollsman | 166/387 X |
| 3,659,648 | 5/1972 | Cobbs | 166/191 X |
| 3,702,193 | 11/1972 | Flegel et al. | 277/207 A X |
| 3,796,260 | 3/1974 | Bradley | 166/202 X |
| 4,023,814 | 5/1977 | Pitts | 277/181 |
| 4,127,168 | 11/1978 | Hanson et al. | 166/203 X |
| 4,356,865 | 11/1982 | Appel et al. | 166/153 |
| 4,616,858 | 10/1986 | Sauer | 285/235 |

*Primary Examiner*—William P. Neuder
*Attorney, Agent, or Firm*—Jerry Semer

[57] ABSTRACT

This invention is a packer which is a short pipe designed to attach to a screen or filter device at one end. The other end is designed to attach to the well pipe or nipple extension or provide a seat for a submersable pump. On the outside of the pipe are four annular rings to provide a seal between the packer and the adjacent strata of earth or pipe casing. Three of the four annular rings extend perpendicular from the pipe. The fourth which attaches to the end of the packer extends in an upwardly concave fashion from the short pipe. On the inside of the packer is an annular ridge in approximately the middle of the short pipe. This ridge keeps the well pipe, nipple extension, submersable pump, and the screen from touching when they are attached to the packer. The packer is made of plastic and can be cast in a single step process.

18 Claims, 2 Drawing Sheets

PLASTIC PACKER

FIELD OF THE INVENTION

This invention relates to a packer for water wells.

BACKGROUND OF THE INVENTION

The present invention is an improved packer for water wells which is especially used in sandy areas. The conventional packer now in use consists of a short metal pipe, usually steel, threaded on the inside at both ends. In use the conventional packer is threaded so that it can be attached to a well casing, then a screen is usually attached to the opposite end of the packer. A packer has to be designed to insure that the water or liquid below it in the well flows through the packer, not between the packer and the pipe casing or the adjacent strata of earth. Therefore, the packer has a means for stopping the flow of liquid around it. There are a great number of methods in the prior art used to achieve this goal. The one most used is to place one or more annular rings on the outside of the packer. These annular rings can be about any shape. P. Kollsman-Patent No. 3,305,367 1968 in FIGS. 1 through 12 shows many of the shapes these annular rings could take. No matter what the shape of the annular rings, they work by fitting tight against the wall of the casing. Basically, all of the methods of stopping the flow work on the principal of fitting tightly against the casing so that no water can pass. Some packers have packs that expand against the casing after they are placed in the well casing. The usual method of causing this expansion is compression on the packer or having a ring or part that expands when wet. Another expansion method is expansion of a balloon-like structure against the pipe casing with a gas. Most conventional packer also contains annular rings made out of elastomer material, usually rubber, around the outside to provide a seal between the packer and the adjacent strata of earth.

One problem with this packer is that it is made out of metal, usually steel. This usually leads to corrosion of the packer as well as corrosion of the well casing and screen, leading to a shorter life for the screen as well as the well casing. The metal packer conducts electricity which allows the electro chemical reaction to take place, causing corrosion. Also, there is the possibility of the two casings and the screen touching when they are screwed into the metal packer. This would cause corrosion of the well casing and screen.

Another problem with this packer is that it is made of two different materials: metal, usually steel, and an elastomer material, usually rubber. The metal portion is usually casted, then threaded, and then the rubber portion is molded on the outside. This two-step process makes the packer expensive to manufacture. Also, there are problems with the rubber metal bond that shortens the life of the packer. The use of rubber as the elastomer material also causes problems in that it is susceptible to tearing. The fact that the packer is made out of metal makes it rather heavy, and thus, makes it expensive to ship and awkward to work with.

There are numerous advantages of the invention. First, the packer is made out of plastic. The plastic chosen for the packer has outstanding hydrolysis resistance and will not corrode like metal. The invention also insures a longer life of the well casing and screen, since the plastic packer will not enhance corrosion of the well casing and the screen. The plastic will not allow the flow of electricity from the well casing to the screen. Secondly, the plastic packer has a protective annular ridge on its inside that keeps the well casing and screen from touching. These two features eliminate any corrosion or the enhancement of corrosion that could be caused by the packer.

Another advantage is that the plastic packer is made of one material. This means it can be molded in a single step process. Therefore, the plastic packer can be produced easier and with less expense. Also, since it is made out of one material, one does not have to worry about the metal to rubber bonds, and the problems with this bond. If the plastic packer is made out of polyurethane, it will have much better tear resistance than the rubber used on the conventional packer. This will make the annular ring seals much tougher and more resistant to tearing. Lastly, the plastic packer weighs substantially less than the conventional metal packer. This makes it less expensive to ship to the job site and less awkward to work with at the job site.

The object of this invention is to produce a packer that is easier and less expensive to manufacture, less expensive to ship, easier to work with, has a long life, and will not cause corrosion of other parts. The main features that make the invention achieve these objectives is that the packer is made of only one material, plastic, and that it has a protective annular ridge on the inside of the packer to insure that the well casing and the screen do not meet.

SUMMARY OF THE DRAWINGS

The drawings illustrate two embodiments of the invention.

SUMMARY OF THE INVENTION

Figure 1:
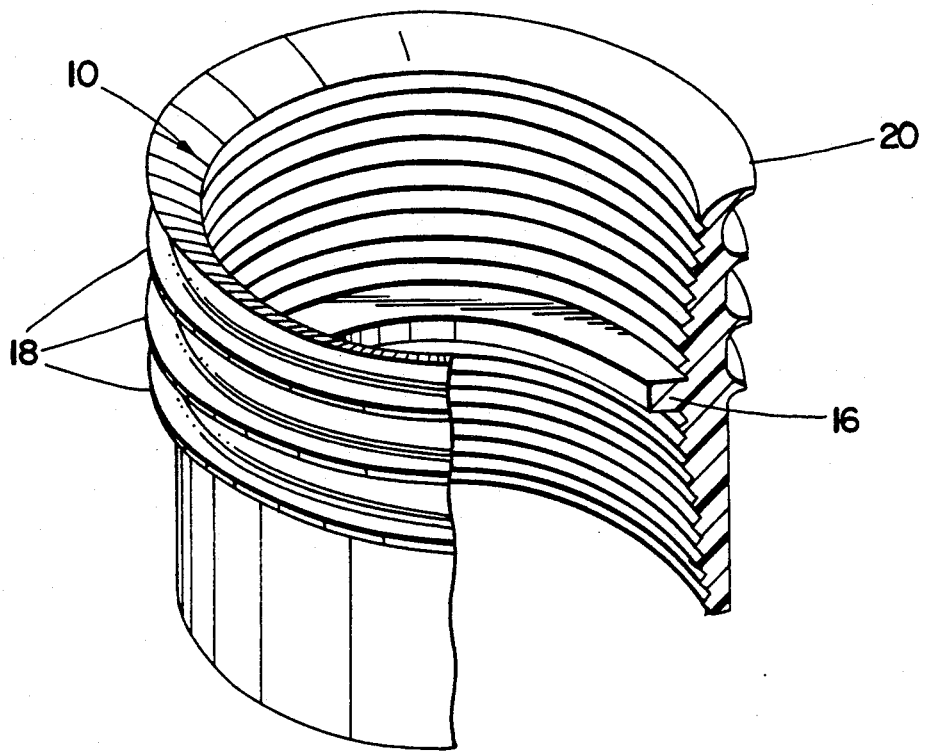
FIG. 1 is the outside view of an embodiment of the invention that is threaded at both ends.

This invention is a packer (10) which is a short pipe (22) designed to attach to a screen (12) or filter device at one end. The other end is designed to attach to the well pipe or nipple extension or provide a seat for a submersable pump. On the outside of the short pipe (22) are four annular rings (18 and 20) to provide a seal between the packer (10) and the adjacent strata of earth or pipe casing (14). Three of the four annular rings extend perpendicular from the short pipe (22). The fourth which attaches to the end of the packer (10) extends in an upwardly concave fashion from the packer (10). On the inside of the packer is an annular ridge (16) in approximately the middle of the short pipe (22). This ridge keeps the well pipe, nipple extension, submersable pump, and the screen (12) from touching when they are attached to the packer (10). The packer (10) is made of plastic and can be cast in a single step process.

DESCRIPTION OF THE PREFERRED EMBODIMENT

Figure 2:
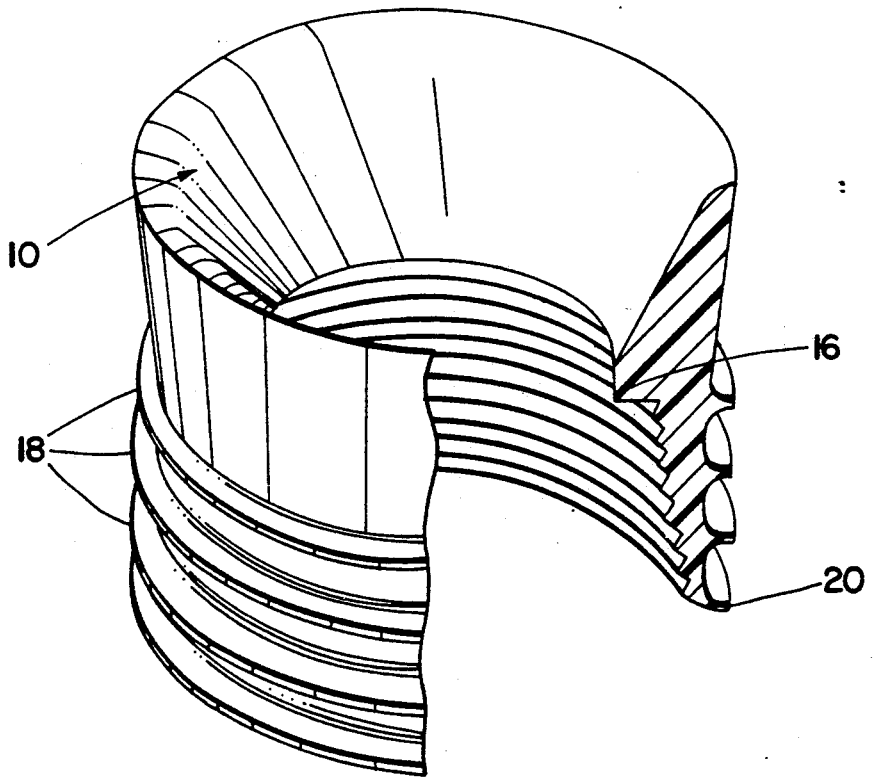
FIG. 2 is the outside view of an embodiment of the invention that is flared at one end.

This invention consists of a short pipe (22) which is threaded on one or both ends. If one end remained unthreaded, it may be flared out as in FIG. 2 and FIG. 4. In one embodiment the short pipe (22) is threaded at both ends and the threads are on the inside as in FIG. 3. This plastic packer (10) is designed so that one end can be attached to the well pipe or nipple extension and the other end can be attached to a screen (12), or filter device or be allowed open. If the plastic packer (10) is the flared out version as in FIG. 2 and FIG. 4, then one end is flared out to a size that is just slightly larger than the well casing. The packer (10) is flared out slightly larger than the well casing so that the packer (10) can be placed in the casing and be able to hold it in position by the friction of the flared end and the annular rings (18 and 20) against the pipe casing (14) or the adjacent strata of earth. A screen (12) is attached to the unflared end of this plastic packer (10) and the plastic packer (10) and screen (12) is lowered in the pipe casing (14) to the proper depth. Then usually the well pipe with a submersable pump on its end is lowered into the flared end of the plastic packer (10). The flared end also acts as an additional seal to stop water from surging between the packer (10) and the pipe casing (14).

In the preferred embodiment the packer (10) on the outside has four annular rings (18 and 20) to provide a seal between the packer (10) and the pipe casing (14) or the adjacent strata of earth. These annular rings (18 and 20) are thin rings, slightly larger than the pipe casing so that they can stop a surge of water between the packer and the pipe casing. The annular rings (18 and 20) are also reinforced where they attach to the short pipe (22) by making them thicker. This reinforcement keeps the annular rings (18 and 20) from being sheared off when placed in a pipe casing (14) whose diameter is too small for the packer (10). In the preferred embodiments the annular rings (18 and 20) are thin and extend outward from the upper half of the pipe as in FIG. 1 and FIG. 3, or the lower half as in FIG. 2 and FIG. 4. Three of the annular rings (18) extend outwardly, perpendicular from the short pipe (22). The outer most annular ring that extends from the end of the packer has a concave shape as shown in FIGS. 1, 2, 3, and 4.

Figure 3:
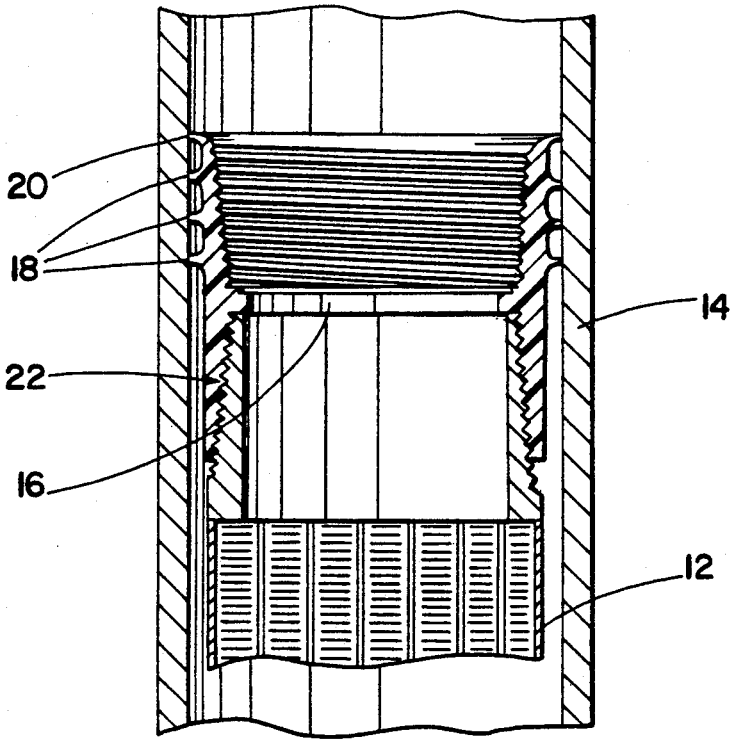
FIG. 3 is a sectional view of an embodiment of the invention that is threaded at both ends.
Figure 4:
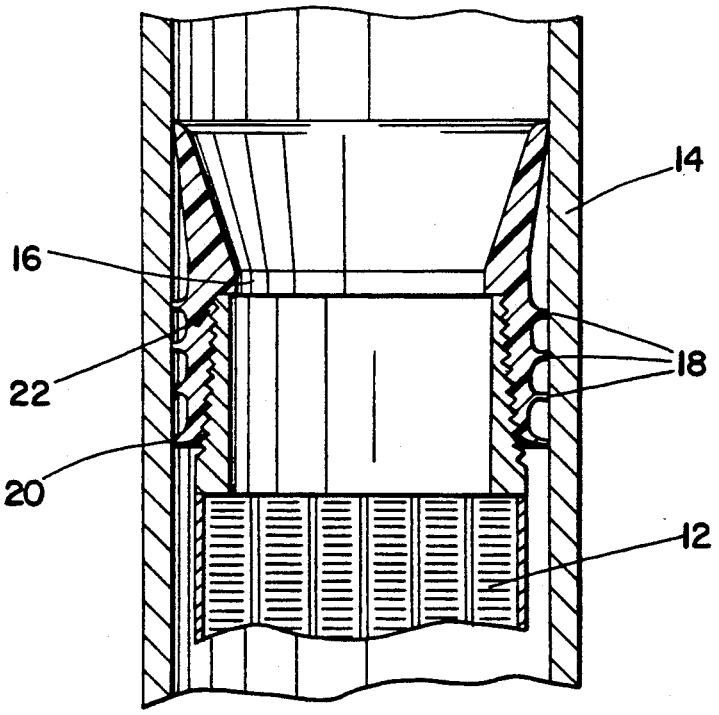
FIG. 4 is a sectional view of an embodiment of the invention that is flared at one end.

The plastic packer (10) has an annular ridge (16) on the inside of the pipe in approximately the middle of the pipe as shown in FIGS. 3 and 4. This ridge is designed to keep the well pipe or pipe nipple extension which is screwed in from one side from touching the screen which is screwed in from the other as in FIGS. 1 and 3. In the embodiment with the flared end this ridge acts not only to keep the well pipe or submersable pump from making contact with the screen, but also acts as a seat for the submersable pump or well pipe.

One of the most important features of the plastic packer (10) is that it is made of plastic. In the preferred embodiments the packer is made of polyurethane. It could also be made of polyproplene or polyethylene or other plastic of sufficient stiffness and hydrolic qualities.

One of the outstanding features of the plastic packer (10) is that it is made of one material. This means it can be molded in a single step process. It can basically be molded by six different processes: open cast, compression molding, transfer molding, injection molding, centrifugal casting, and vacuum molding. In the open cast method the plastic is poured into an open plastic packer (10) mold and allowed to set. The mold is then opened and the plastic packer is taken out. In the compression molding method the plastic is put into an expanded mold. The mold is then compressed and held until the plastic has set. The plastic packer (10) is then removed from the mold. In transfer molding the plastic is then forced through sprues and runners in a compression mold of the plastic packer (10). The plastic is held in the compression mold under pressure until it has set.

In the injection mold process the plastic material in a fluid or semi-fluid is forced into the mold of the plastic packer (10) under pressure and held until the reactants set. In centrifugal casting the plastic material enters the center of the plastic packer mold and is pushed into the mold cavity by centrifugal force. The centrifugal force continues until all the reactants have set. In the vacuum molding the plastic packer (10) mold is placed in a vacuum chamber and the air is evacuated. The mold is then filled with plastic and held until the reactants have set.

Many changes and modifications in the above described embodiment of the invention can, of course, be carried out without departing from the scope thereof. Accordingly, the scope is intended to be limited only by the scope of the appending claim.

What is claimed is as follows:

1. A packer comprising:
a. a short pipe with two ends and an inside and a outside adapted to allow liquids to flow through it; and
b. a means for stopping liquids from flowing between the outside of the packer and an adjacent strata; and
c. the packer is made of a single material.
2. A packer as in claim 1 wherein:
a. the single material is plastic.
3. A packer as in claim 1 wherein:
a. the single substance will not enhance any material coming in contact with the packer to corrode.
4. A packer as in claim 1 further comprising:
a. an annular ridge on the inside of a short pipe and not near either end of the short pipe.
5. A packer as in claim 2 further comprising:
a. an annular ridge on the inside of the short pipe and not near either end of the short pipe.
6. A packer as in claim 2 wherein:
a. the means for stopping the flow of liquids comprising one or more annular rings attached to the outside of the packer.
b. at least one of the annular rings extends outwardly in a concave fashion.
7. A packer as in claim 5 wherein:
a. the means for stopping the flow of liquids comprising one or more annular rings attached to the outside of the packer.
b. at least one of the annular rings extends outwardly in a concave fashion.
8. A packer as in claim 1 prepared by a process comprising:
c. molding or casting the packer.
9. A packer for a well comprising:
a. a short pipe with two ends and an inside and a outside adapted to allow liquids to flow through it; and
b. a means for stopping liquids from flowing between the outside of the packer and an adjacent strata; and
c. a means for joining the packer with a means for conveying a liquid out of the well; and
d. the packer is made of a single material.
10. A packer as in claim 9 wherein:
a. the single material is plastic.
11. A packer as in claim 9 further comprising:
a. an annular ridge on the inside of the short pipe and not near either end of the short pipe.
12. A packer as in claim 10 further comprising:

a. an annular ridge on the inside of the short and not near either end of short pipe.

13. A packer as in claim 9 wherein:

a. the means for joining is that the packer is threaded on one end.

14. A packer as in claim 9 further comprising:

a. a means for attaching a means for filtering to one end of the packer.

15. A packer as in claim 14 wherein:

a. the means for attaching is that the packer is threaded at one end.

16. A packer as in claim 14 wherein:

a. the means for joining is that the packer is threaded at one end; and b. the means for attaching is that the packer is threaded at the other end.

17. A packer as in claim 11 further comprising:

a. a means for attaching a means for filtering to one end of the packer.

18. A packer as in claim 17 wherein:

a. a means for joining is that the packer is threaded at one end; and b. the means for attaching is that the packer is threaded at the other end.

* * * * *